United States Patent [19]

Luke

[11] Patent Number: 4,578,053

[45] Date of Patent: Mar. 25, 1986

[54] TOBACCO-SMOKE FILTERS

[75] Inventor: John A. Luke, Eastleigh, England

[73] Assignee: British-American Tobacco Company Limited, London, England

[21] Appl. No.: 570,829

[22] Filed: Jan. 16, 1984

[30] Foreign Application Priority Data

Jan. 26, 1983 [GB] United Kingdom ..... 8302058

[51] Int. Cl.[4] ..... A24C 5/50

[52] U.S. Cl. ..... 493/45; 493/43

[58] Field of Search ..... 493/42, 40, 45, 47, 493/2, 49

[56] References Cited

U.S. PATENT DOCUMENTS

| | | | |
|---|---|---|---|
| 4,024,001 | 5/1977 | Lyon | 493/43 |
| 4,075,936 | 2/1978 | Berger | 493/43 |
| 4,164,438 | 8/1979 | Lebet | 493/43 |
| 4,436,517 | 3/1984 | Lebet | 493/43 |

*Primary Examiner*—Leon Gilden

*Attorney, Agent, or Firm*—Kane, Dalsimer, Kane, Sullivan and Kurucz

[57] ABSTRACT

For the manufacture of filter rod, filtration material and plugwrap being a thermally mouldable paperlike material, are fed, continuously to a rod maker, said plugwrap and rod being brought into contact with a heated moulding means to produce an impression in the peripheral surface of said plugwrap whilst preserving the continuity of the said wrap. The plugwrap includes not less than 25%, suitably 45 to 95%, by weight of synthetic thermoplastic material. At least a substantial proportion of the said thermoplastic material may be in the form of fibrillated fibre. The thermoplastic material may comprise polyethylene and/or cellulose acetate. The thickness of the plugwrap advantageously does not exceed 140 microns and its permeability prior to contact with said heated moulding means does not exceed 100 Coresta Units. By the said impression, the plugwrap is transformed from a paperlike material to a filmlike material of reduced permeability. The rod may be cut into discrete lengths thereof before it is brought into contact with said heated moulding means.

2 Claims, 1 Drawing Figure

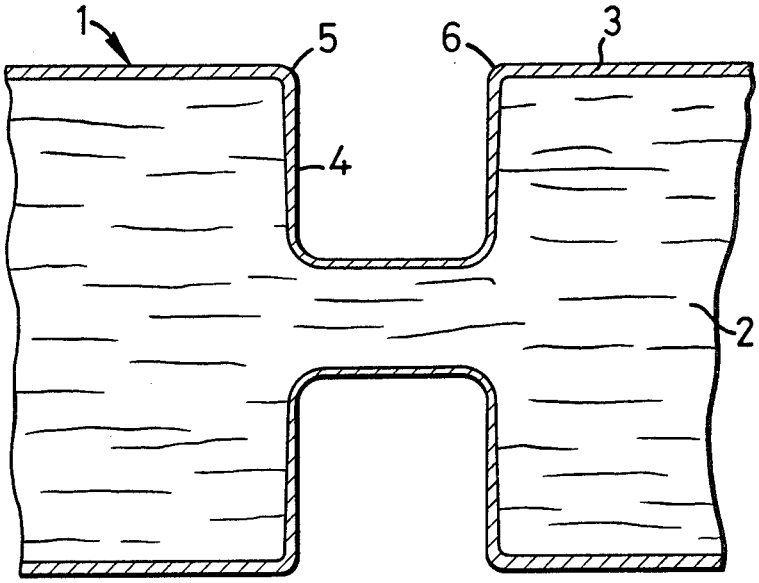
1
5
6
3
4
2

TOBACCO-SMOKE FILTERS

This invention relates to tobacco-smoke filters, for cigarettes for example, and to the manufacture thereof.

Various cigarettes have been proposed which comprise a plug of filtration material provided with one or more depressions in the peripheral surface of the plug. In the specification of our United Kingdom Pat. No. 1,592,549, there is described a filter having a self-bonded filter plug, i.e. a non-wrapped plug, which is provided with a comparatively deep depression in the form of an annular groove. It is essential for the proper performance of the filtration mechanism of this filter that the walls of the annular groove are substantially impervious to tobacco smoke. According to the teaching of Specification No. 1,592,549, the annular groove is formed by revolving the filter plug against a blade which is maintained at a temperature sufficient to melt the filtration material of which the plug is composed. In some circumstances the walls of the groove will be glazed by the hot blade and thereby rendered at least partially impervious to tobacco smoke. In practice it has been found advantageous to introduce a sealant material into the groove to ensure that the walls thereof possess the required degree of imperviousness. Apparatus operable to introduce a sealant material into annular grooves is described in United Kingdom Specification No. 2,033,207. The use of a sealant material increases the cost and complexity of filter plug manufacture.

In the manufacture of filter tipped cigarettes it is the usual current practice to use wrapped rather than non-wrapped filter plugs. A wrapped plug comprises filtration material, commonly cellulose acetate fibres, wrapped in a plugwrap. The plugwrap is most usually a paper composed mainly of cellulosic fibres, although proposals have been made for plugwraps the constitution of which comprises a proportion of thermoplastic fibres. Plugwraps of this type are disclosed in United Kingdom Patent Specifications Nos. 2,056,841 and 2,058,543.

According to one aspect, it is an object of the present invention to enable filter plugs to be provided having surface depressions of tobacco-smoke perviousness of a low order, without relying on heat glazing or using a sealant. A further object is to provide a plugwrap or plug which possesses advantageous characteristics.

In accordance with the aforesaid first aspect, the invention provides a method of manufacture of filter rod, wherein filtration material and plugwrap are fed continuously to a rod maker, said plugwrap being a thermally mouldable paperlike material, and the rod is brought into contact with a heated moulding means to produce thereby an impression in the peripheral surface of said rod whilst preserving the continuity of said plugwrap.

The present invention also provides filter rod comprising filtration material wrapped in a plugwrap of a thermally mouldable paperlike material, said rod comprising a thermally moulded impression in the peripheral surface thereof and said plugwrap providing a continuous lining of said impression.

The plugwrap possesses its characteristics of thermal mouldability by virtue of the inclusion therein of not less than 25% by weight of synthetic thermoplastics material, a substantial proportion, for example at least 80%, of which is suitably in the form of fibrillated fibre. Advantageously, the inclusion level of thermoplastic material is in a range of 45% to 95%. At least a substantial proportion of the balance to 100% should be of cellulosic fibres. The synthetic thermoplastic material may, for example, be constituted by a polyolefin, polyethylene or polypropylene material.

Suitably, the filter rod is cut into discrete rod lengths, equivalent to six fliter-plug lengths for example, before the rod is subjected to the thermal moulding step.

The aforesaid relative movement between the moulding means and the filter rod may take place in a single direction, radially of the rod, for example, or it may take place with components in two directions. Thus, for instance, there may be imposed on a radial relative movement, a rotary relative movement about the rod axis. In the process of causing the redistribution of material originally forming part of the plugwrap at the periphery of the filter rod, the heated moulding means also produces an at least partial fusion of the thermoplastic content. With plugwraps containing thermoplastic material of a sufficiently low melting point, polyethylene or cellulose acetate for example, the permeability can be reduced in this manner to low values, even substantially to zero. The fusion effect is dependent on the amount of heat transferred from the moulding means to the plugwrap, this being a function of temperature and time of contact. Too high a temperature will cause degradation of the plugwrap material, resulting in destruction of the integrity thereof.

If a thermally moulded impression is a comparatively deep one, the moulding process may readily result in a transformation of the plugwrap from a paperlike material to a filmlike material of low permeability. This transformation results from the effect of the thermal moulding process on the thermplastic content of the plugwrap, the cellulosic fibres being unaffected by the heat. This filmlike material may be thermally bonded to the underlying filtration material. In the case of a shallow thermally moulded impression, such transformation of the plugwrap may not occur, or only occur to a slight extent, since the material of the plugwrap is subjected to only a limited degree of redistribution. Thus if it is required that the portion of plugwrap lining a shallow groove is of low permeability, it may be appropriate to use plugwrap which has been manufactured with an initial permeability of low value. Plugwrap having an initial permeability not greater than 100 Coresta units, for example, could be used. When, on the other hand, a deep impression is to be formed, plugwraps of higher initial permeability may be usable, since the fusion/-redistribution transformation of the portion of the plugwrap subjected to the groove-forming moulding process will effect a marked reduction in the permeability of that portion.

In order to ensure acceptable runnability on a filter-rod making machine, the plugwrap should have a minimum tensile strength, measured along any axis, of at least 8 Newtons per 25 millimeters of width transverse to the measurement axis. The required tensile strength may be achieved by heat and/or pressure consolidation or by coating with a binder or a film-forming material and a polyvinyl alcohol or polyvinyl acetate or by a combination of such consolidation and coating.

The thickness of the plugwrap should not exceed 140 microns. The weight of the plugwrap should no exceed 80 grammes per square meter amd is suitably less than 50 grammes per square metere.

The synthetic thermoplastic content of the plugwrap which is in fibrous form may be supplemented by an inclusion of synthetic thermoplastic material in particulate form. The fibrous and/or the particulate thermoplastic content may comprise more than one thermoplastic material.

The cellulosic fibres in the plugwrap may, for example, be of bleached softwood sulphate bleached sulphite or cotton linters. Loadings of papermaking additives such as titanium dioxide or calcium carbonate may also be included.

The invention will now be described by way of example with reference to the accompanying drawing, which shows, in axial section, a portion of the length of a cigarette filter rod.

Crimped cellulose acetate tow, as filtration material, and plugwrap were fed continuously to a Hauni KDF 2 filter-rod making machine to produce filter rod 1 of 24.8 millimeteres circumference comprising tow 2 wrapped in plugwrap 3. The tow 2 was plasticised using triacetin and the plugwrap 3 was seam sealed using a polyvinyl acetate adhesive.

The plugwrap 3 was a paperlike material comprising 50% by weight of fibrillated fibres of polyethylene, designated Pulpex E, and 50% cellulosic fibres designated Stora 22. The weight of the plugwrap was 37 grammes per square meter. As a final step in the making process thereof, the plugwrap was subjected to infrared heating at 180° C. for 3 minutes to effect consolidation. Post consolidation, the permeability of the plugwrap was 60 Coresta units, the thickness was 90 microns, and the tensile strength was 34 Newtons/25 millimeters width in the machine direction and 24 Newtons/25 millimeters width in the cross section.

The filter rod 1 produced by the filter-rod maker was cut into lengths equivalent to six filter plug lengths. Thermal moulding apparatus generally similar to that described in the specification of our United Kingdom Patent No. 1,507,765 was then employed to mould deep annular grooves into each of the rod lengths. One such groove, having reference numeral 4, is indicated in the drawing. After completion of the thermal moulding step the plugwrap 3 maintained its integrity and thus served to provide a continuous lining to the groove 4. It may be noted that the continuity of the plugwrap 3 is preserved notwithstanding the sharpness of the outer corners 5, 6 of the groove 4. The termal moulding step producing the groove 4 resulted in a reduction of the permeability, to substantially zero, of that portion of the plugwrap lining the groove 4, said portion having been transformed from a paperlike material to a filmlike material.

Subsequently the filter-rod lengths were cut to provide six discrete filter plugs each comprising a groove like the groove 4.

Details of seven further plugwrap materials acceptable for use in the manufacturing method according to the invention are given in the table. The plugwrap designated Example 6 in the table could also be used after having been sized in order to reduce the permeability of the plugwrap, It was found that using polyvinyl alcohol as a size, the permeability of the Example 6 material could be reduced to 83 Coresta units.

Since the plugwraps contain a proportion of the thermoplastic material, as an alternative to using an adhesive to seam seal them, they can be sealed by the application of heat.

| Examples | Furnish: Synthetic Pulp % | Furnish: Cellulosic Pulp % | Post Cansolidation Tensile Strength (Newtons/25 mm Width): Machine Direction | Post Cansolidation Tensile Strength (Newtons/25 mm Width): Cross Direction | Post Consolidation Permeability (cc/min/cm$^2$ at 10 cms W.G.) | Grammage (gms/m$^2$) | Post Consolidation Thickness (Microns) |
|---|---|---|---|---|---|---|---|
| 1 | 75% Solvay Pulpex E (Polyethylene) | 25% Stora 32 | 34 | 19 | 3 | 36 | 90 |
| 2 | | | 28 | 17 | 50 | 30 | 75 |
| 3 | | | 29 | 18 | 25 | 37 | 82 |
| 4 | | | 36 | 22 | 16 | 38 | 85 |
| 5 | | | 37 | 17 | 10 | 45 | 99 |
| 6 | 75% Solvay (Polypropylene) | 25% Stora 32 | 15 | 9 | 4,080 | 35 | 134 |
| 7 | 80% Cellulose Acetate | 20% Wood Pulp | 18 | 10 | 24,500 | 41 | 94 |

What is claimed is:

1. A method of manufacture of filter rod which comprises feeding filtration material and plugwrap, being a thermally mouldable paperlike material contains theomaplastic material in the range of 25 to 95 percent of the plug wrap, continuously to a rod maker, and bringing the rod into contact with a heated moulding means, whereby an impression is produced in the peripheral surface of said plugwrap and the impressed part of the plugwrap is transformed from said paperlike material to a film-like material of reduced permeability whilst the continuity of said plugwrap is preserved.

2. A method according to claim 1, wherein said filter rod is cut into discrete lengths thereof before said rod is brought into contact with said heated moulding means.

* * * * *

UNITED STATES PATENT AND TRADEMARK OFFICE

CERTIFICATE OF CORRECTION

PATENT NO. : 4,578,053

DATED : March 25, 1986

INVENTOR(S) : John A. Luke

It is certified that error appears in the above-identified patent and that said Letters Patent is hereby corrected as shown below:

Col. 2, line 34; - "thermplastic" should read -- thermoplastic --

Col. 2, line 64; - "no exceed" should read -- not exceed --

Col. 3, line 51; - "cross section" should read -- cross direction --

Col. 3, Chart; 3rd Column across; - "Post Cansolidation" should read -- Post Consolidation --

Col. 3, Chart; under "Synthetic Pulp %" heading opposite Example 6, insert -- Pulpex P --

Col. 4, line 4; - "termal" should read -- thermal --

Col. 4, line 49; - "theomaplastic" should read -- thermoplastic -

Signed and Sealed this

*Ninth* Day of *September 1986*

[SEAL]

*Attest:*

DONALD J. QUIGG

*Attesting Officer*

*Commissioner of Patents and Trademarks*